US011814935B2

(12) United States Patent
Constantine et al.

(10) Patent No.: US 11,814,935 B2
(45) Date of Patent: Nov. 14, 2023

(54) ORIENTATION RING

(71) Applicant: ConocoPhillips Company, Houston, TX (US)

(72) Inventors: Jesse J. Constantine, Houston, TX (US); Robert Hand, Houston, TX (US); Neal Adams, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 17/703,698

(22) Filed: Mar. 24, 2022

(65) Prior Publication Data

US 2022/0307352 A1 Sep. 29, 2022

Related U.S. Application Data

(60) Provisional application No. 63/165,414, filed on Mar. 24, 2021.

(51) Int. Cl.
*E21B 43/119* (2006.01)
*E21B 17/042* (2006.01)

(52) U.S. Cl.
CPC ..... *E21B 43/119* (2013.01); *E21B 17/0423* (2013.01)

(58) Field of Classification Search
CPC ..... E21B 17/10; E21B 17/0423; E21B 23/01; E21B 23/02; E21B 23/03
See application file for complete search history.

(56) References Cited

U.S. PATENT DOCUMENTS 1,734,439 A * 11/1929 Livergood ..... E21B 31/107 30/103
4,410,051 A * 10/1983 Daniel ..... E21B 43/1185 175/4.51
2002/0185275 A1 12/2002 Yang et al.
2006/0201675 A1* 9/2006 Ferguson ..... E21B 34/10 166/298

(Continued)

OTHER PUBLICATIONS

International Search Report and Written Opinion of The International Searching Authority for International Application No. PCT/US 22/21742 dated Jun. 22, 2022 (8 pages).

*Primary Examiner* — Tara Schimpf
*Assistant Examiner* — Yanick A Akaragwe
(74) *Attorney, Agent, or Firm* — Polsinelli PC

(57) ABSTRACT

Implementations described and claimed herein provide systems and methods for increasing accuracy of firing perforating charges in an oil well casing. In one implementation, a body of an orientation device has a first portion and a second portion. An opening extends through a center of the body from a first lateral surface to a second lateral surface, and the opening is configured to receive a perforating gun string. An outer perimeter surface extends about the center of the body from the first lateral surface to the second lateral surface. The outer perimeter surface has a first shape associated with the first portion and a second shape associated with the second portion. The second shape forms a base portion configured to maintain the perforating gun string in an orientation by preventing rotation of the perforating gun string. The orientation corresponds to a predetermined perforating charge direction of the perforating gun string.

16 Claims, 5 Drawing Sheets

(56) References Cited

U.S. PATENT DOCUMENTS

| | | | | |
|---|---|---|---|---|
| 2012/0145380 | A1* | 6/2012 | Draper | E21B 17/05 166/241.3 |
| 2016/0017689 | A1* | 1/2016 | Steele | E21B 34/12 166/330 |
| 2018/0135359 | A1 | 5/2018 | Hradecky et al. | |
| 2018/0363423 | A1* | 12/2018 | Hradecky | E21B 41/00 |

* cited by examiner

ORIENTATION RING

CROSS-REFERENCE TO RELATED APPLICATIONS

The present application claims priority to U.S. Provisional Patent Application No. 63/165,414, filed on Mar. 24, 2021 and entitled "Orientation Ring," which is incorporated by reference in its entirety herein.

TECHNICAL FIELD

Aspects of the present disclosure relate generally to systems and methods for orienting a perforating gun string in an oil well perforation operation and more particularly an orientation ring orienting a perforating gun string to maintain a predetermined perforating charge direction for an oil well perforation operation.

BACKGROUND

Oil well perforation is generally a process used to establish a flow path between a hydrocarbon reservoir and a wellbore, which involves running a perforating gun string in the wellbore to a desired depth and firing charges from the perforating gun string to perforate the well casing or liner. In oil well perforation, orientation of the perforating gun string controls a direction of holes created by gun charges. However, round gun strings often roll out of orientation, creating a perforation out of phase or such that additional runs may be needed. This decreases productivity and increases time and costs. These challenges are further exacerbated if the perforating gun string becomes disfigured once it is fired (e.g., changing shape from generally round to oval). It is with these observations in mind, among others, that various aspects of the present disclosure were conceived and developed.

SUMMARY

Implementations described and claimed herein address the foregoing problems by providing systems and methods for increasing accuracy of firing perforating charges in an oil well casing with a perforating gun string. In one implementation, a body of an orientation device has a first portion and a second portion. An opening extends through a center of the body from a first lateral surface to a second lateral surface, and the opening is configured to receive the perforating gun string. An outer perimeter surface extends about the center of the body from the first lateral surface to the second lateral surface. The outer perimeter surface has a first shape associated with the first portion and a second shape associated with the second portion. The second shape forms a base portion configured to maintain the perforating gun string in an orientation by preventing rotation of the perforating gun string. The orientation corresponds to a predetermined perforating charge direction of the perforating gun string.

Other implementations are also described and recited herein. Further, while multiple implementations are disclosed, other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Aspects of the present disclosure involve systems and methods for orienting a perforating gun string in an oil well perforation operation. In one aspect, an orientation device includes a body with an opening extending through a center of the body. The body has a first portion including a plurality of notches, and a base portion. The base portion passively maintains the perforating gun string in a predetermined perforating charge direction by preventing rotation of the perforating gun string within the oil well casing. Generally, the presently disclosed technology increases accuracy of perforation charge firing by passively maintaining an orientation of a perforating gun string in an oil well casing, thereby decreasing time and costs associated with an oil well perforation operation and eliminating or otherwise reducing out of phase shots. The orientation device has no moving parts and is a single integrated piece facilitating deployment and use. Other advantages will be apparent from the present disclosure.

Figure 1:
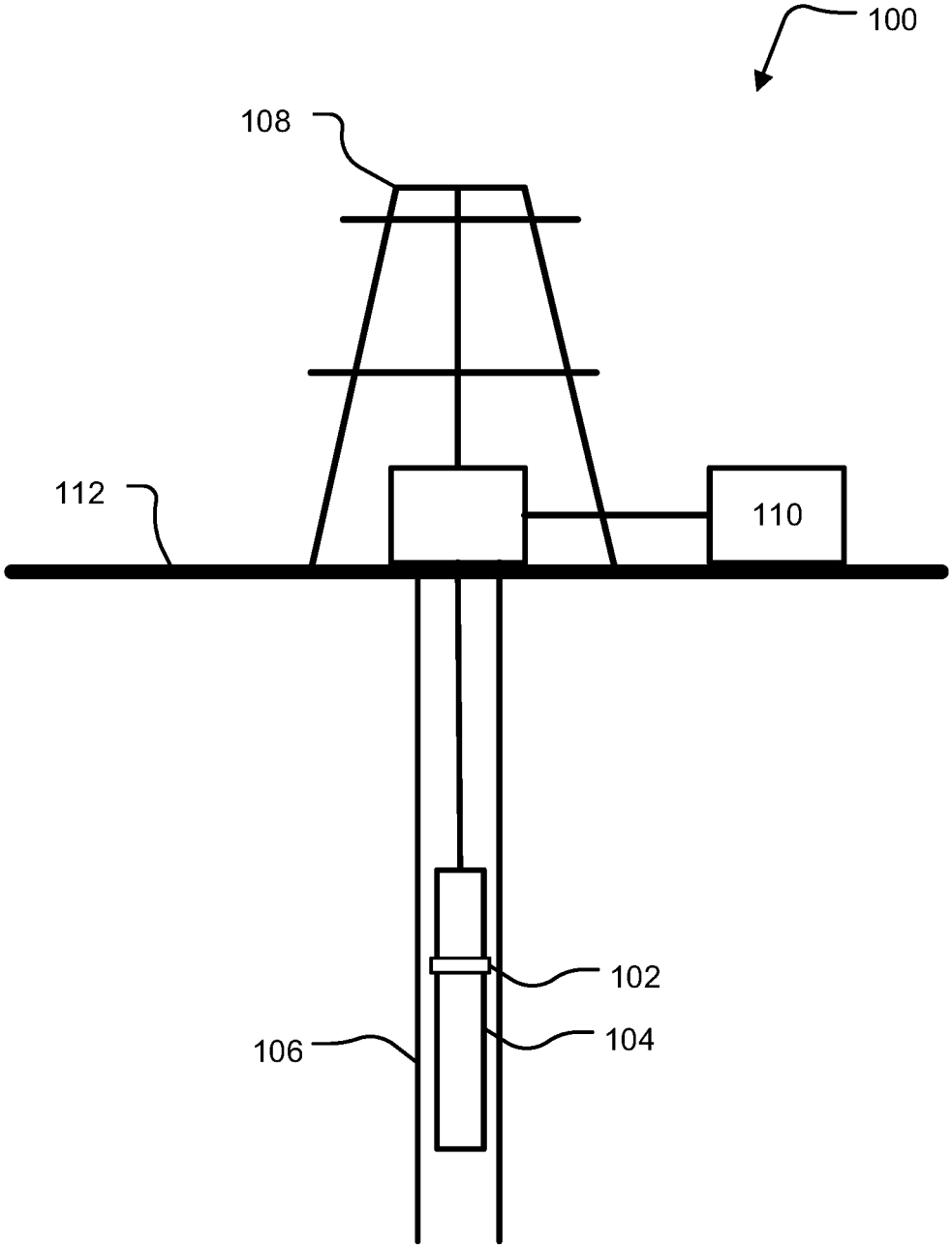
FIG. 1 illustrates an example oil perforation operation using an example orientation ring.
Figure 2:
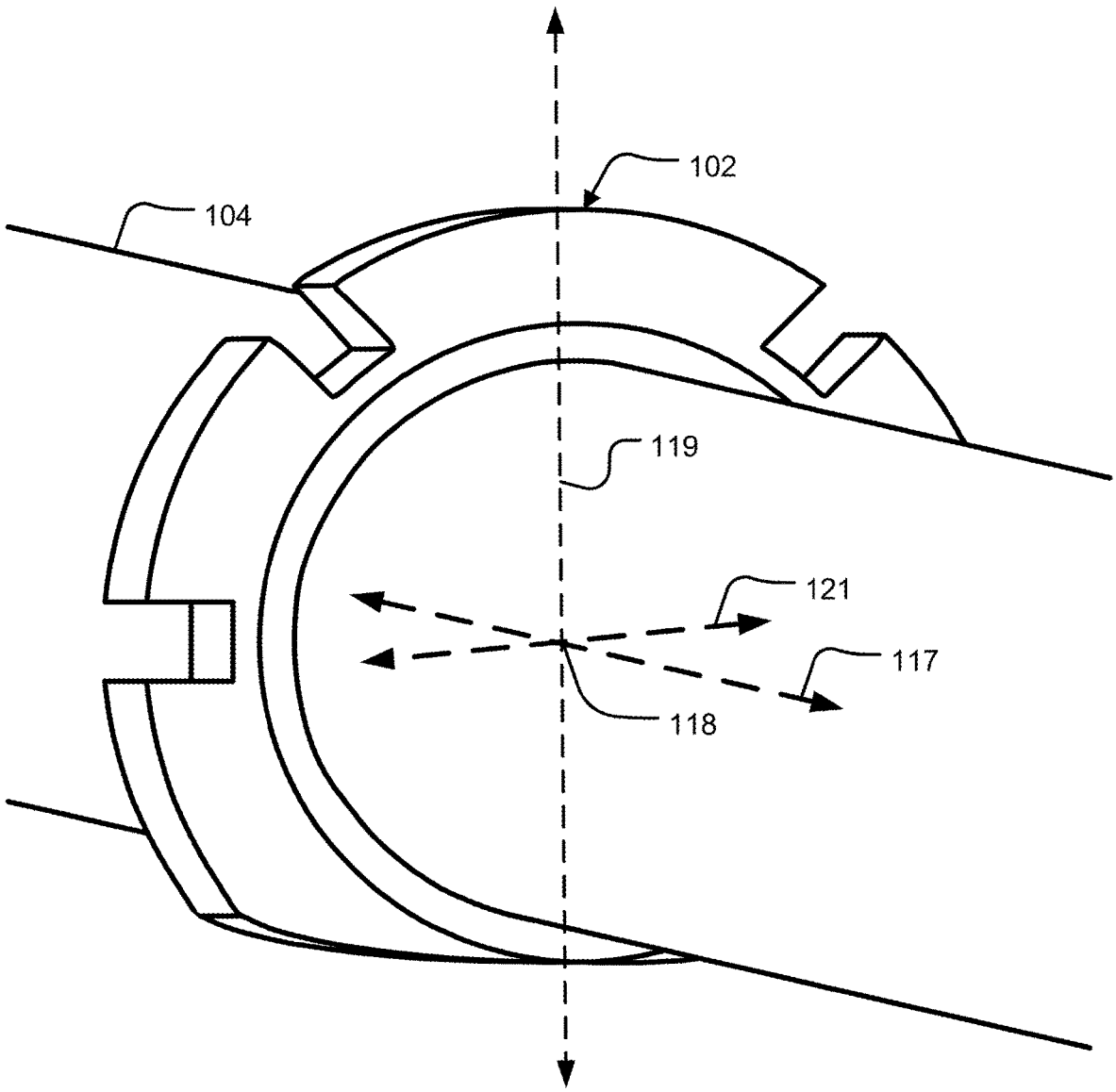
FIG. 2 is a front perspective view of an example orientation ring for orienting an example perforating gun string in an oil well perforation operation.

To begin a detailed description of systems and methods for orienting a perforating gun string in an oil well perforation operation, reference is made to FIGS. 1-2. FIG. 1 illustrates an oil well perforation operation 100 and FIG. 2 shows an orientation device 102 secured to a perforating gun string 104. Those skilled in the art will recognize that FIG. 1 is exemplary only and various equipment, apparatuses, and/or systems for oil well perforation operations have been omitted for clarity. Such components might include, for example, temperature and pressure controls, pumps, motors, filters, heat exchangers, valves, and/or the like. Those skilled in the art will recognize such components and how they are integrated into the systems and methods disclosed herein.

The oil well perforation operation 100 generally involves the orientation device 102 secured to the perforating gun string 104, such that the orientation device 102 extends about the perforating gun string 104. The perforating gun string 104 extends through the orientation device 102 in a first direction 117. The first direction 117 may extend along a length of the perforating gun string 104, with a second direction 119 extending transverse to the length of the perforating gun string 104. A third direction 121 extends generally transverse to both the first direction 117 and the second direction 119. The orientation device 102 may have a center 118 defining a central axis coaxial with a central axis of the perforating gun string 104 and extending along the first direction 117.

In one implementation, the perforating gun string 104 is deployed within a wellbore casing 106. The perforating gun string 104 is connected to a wellhead 108 and a perforating unit 110 on a surface 112. At the surface 112, the perforating unit 110 controls the perforating gun string 104 to move the perforating gun string 104 to a desired depth within the wellbore casing 106, a well as firing perforating charges through the wellbore casing 106 and into the hydrocarbon reservoir. The perforating charges cause hydrocarbons to flow from the reservoir into the wellbore casing 106. The orientation device 102 maintains the orientation of the perforating gun string 104 within the wellbore casing 106 while the perforating charges are fired.

Figure 3:
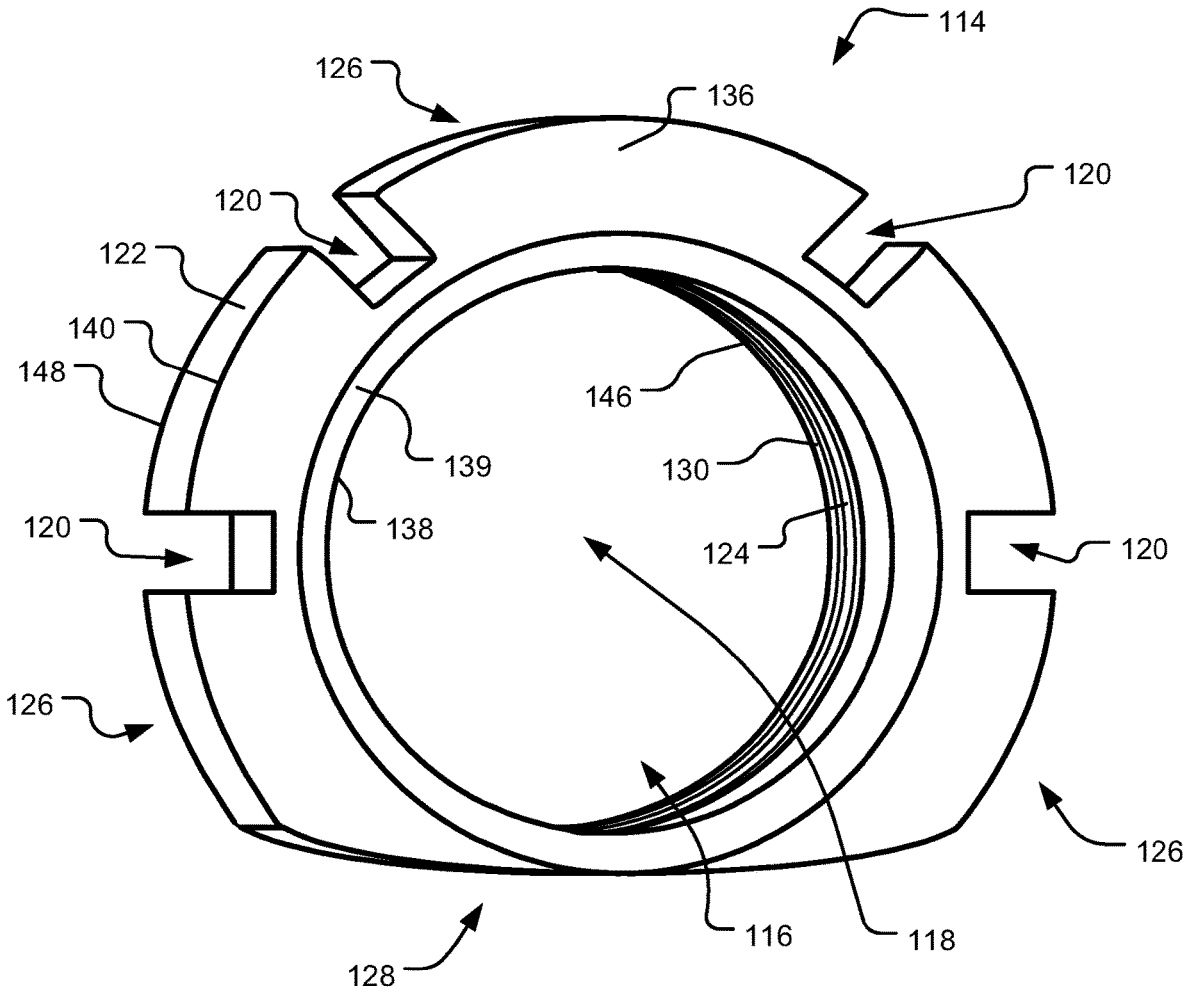
FIG. 3 is a front perspective view of the orientation ring.
Figure 4:
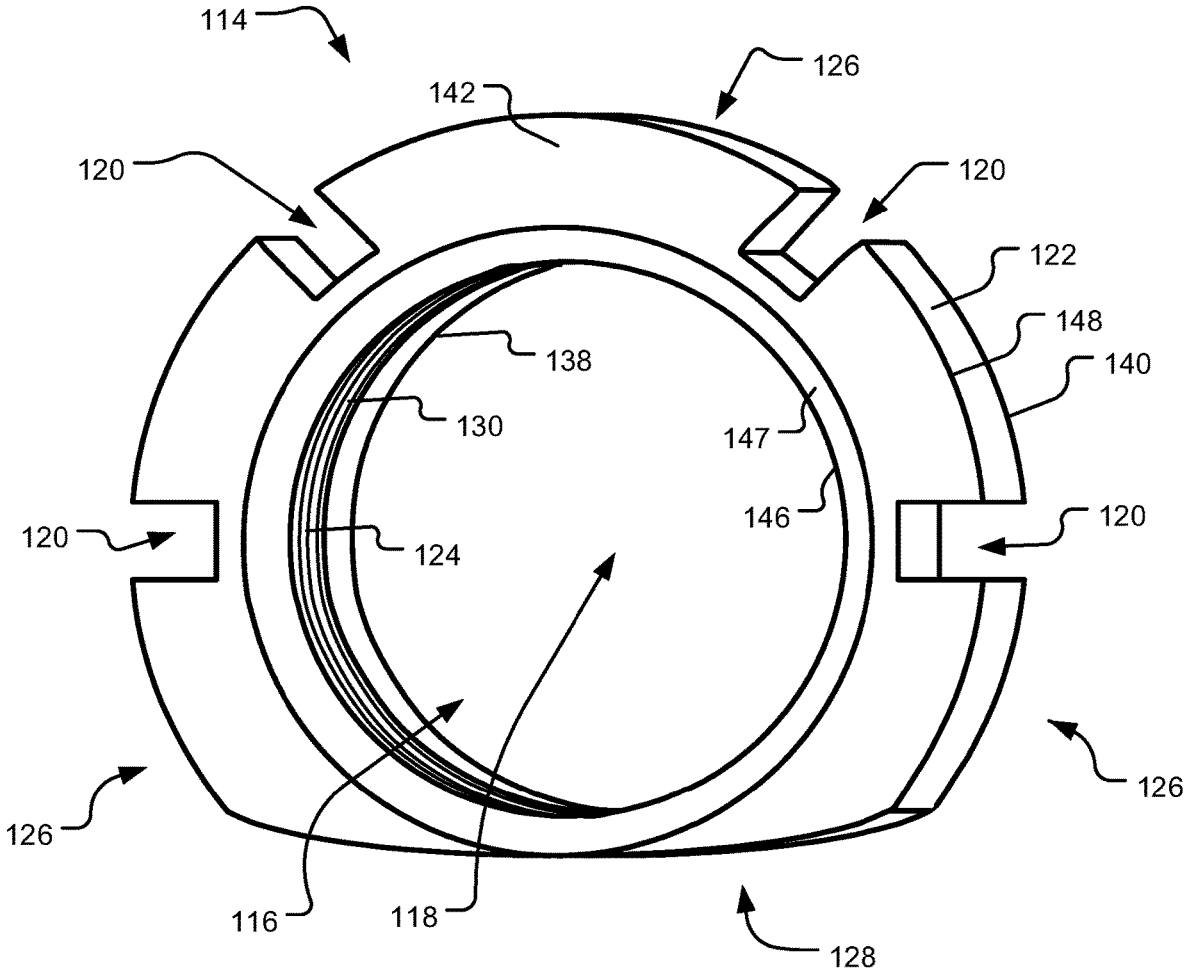
FIG. 4 is back perspective view of the orientation ring.

Turning to FIGS. 3-4, a front perspective view and a back perspective view, respectively, of the orientation device 102, which may be an orientation ring, are shown. In one implementation, the orientation device 102 includes a body 114. The body 114 may comprise metal and/or other materials. In one implementation, the body 114 includes an opening 116 defined in and extending through the body 114. The opening 116 may be positioned relative to a center 118 of the body 114. As shown in FIG. 2, the body 114 receives the perforating gun string 104 through the opening 116.

In one implementation, the body 114 includes a first portion 126 disposed at a proximal end of the body 114 and a second portion 128 disposed at a distal end of the body 114. The second portion 128 forms a base portion that when the perforating gun string 104 is received in the opening 116, the base portion is aligned with eccentric weight bars of the perforating gun string. The eccentric weight bars may be used to maintain a predetermined charge direction and phasing, with roller bearing sleeves reducing friction of the perforating gun string 104 within the wellbore casing 106 and facilitating orientation of the perforating gun string 104 using the counter weight of the eccentric weight bar. The first portion 126 extends from the second portion 128 in the second direction 119 and between a first lateral surface 136 and a second lateral surface 142 in the first direction 117. In one implementation, the first direction 117 extends along a length of the opening 116, and the second direction 119 extends across the opening 116. A width of the body 114 measured between the first lateral surface 136 and the second lateral surface 142 in the first direction 117 may be a fixed or taper in toward the first and second outer perimeter edges 140 and 148, such that the inner perimeter surface 124 may be wider than the outer perimeter surface 122.

The body 114 includes an outer perimeter surface 122 and an inner perimeter surface 124. The inner perimeter surface 122 may be positioned opposite the outer perimeter surface 122. The outer perimeter surface 122 extends about the center 118 of the body 114. In one implementation, the outer perimeter surface 122 has a first shape relative to the first portion 126 and a second shape relative to the second portion 128. For example, the second shape of the outer perimeter surface 122 is flatter than the first shape. In one implementation, the second shape of the outer perimeter surface 122 extends from a first end to a second end in the third direction 121 across the body 114. The first shape of the outer perimeter surface 122 extends along a curve about the center 118 between the first end and the second end of the outer perimeter surface 122 at the second portion 128. The second shape of the second portion 128 maintains the perforating gun string 104 in a predetermined perforating charge direction by preventing the perforating gun string 104 from rotating within the wellbore casing 106.

One or more notches 120 may be defined in the body 114. The notches 120 may be used to receive and engage various tools and components in connection with the oil well perforation operation 100. The notches 120 may be defined in the first portion 126 of the body 114 and extend from the outer perimeter surface 122 inwardly towards the center 118. The notches 120 may include a first set of notches disposed radially opposite each other and a second set of notches disposed at the proximal end of the body 114. The notches 120 may be symmetrically positioned on the first portion 126 of the body 114. It will be appreciated that while four notches are shown in the Figures, any number of notches and other configurations is contemplated.

The opening 116 is defined by the inner perimeter surface 124 of the body 114. The inner perimeter surface 124 may be adapted to be fitted and secured around an exterior perimeter of the perforating gun string 104. The inner perimeter surface 124 or other portions of the body 114 may include one or more fasteners to engage the perforating gun string 104. For example, the orientation device 102 may include a first set of threads 130 on at least a portion of the inner perimeter surface 124 of the body 114 that engage a second set of threads on an exterior surface of the perforating gun string 104. The first set of threads 130 position the body 114 in an orientation on the perforating gun string 104 to maintain the perforating gun string 104 in a predetermined perforating charge direction. It will be appreciated that other structures or methods for securing the orientation device 102 to the perforating gun string 104 may be implemented.

In one implementation, the first lateral surface 136 includes a first inner perimeter edge 138 and a first outer perimeter edge 140. The second lateral surface 142 similarly includes a second inner perimeter edge 146 and a second outer perimeter edge 148. The inner perimeter surface 124 may be disposed between the first inner perimeter edge 138 and the second inner perimeter edge 146. The outer perimeter surface 122 is disposed between the first outer perimeter edge 140 and the second outer perimeter edge 148. In one example, the first inner perimeter edge 138 includes a first beveled edge 139, and the second inner perimeter edge 146 includes a second beveled edge 147. The second portion 128 may abut the beveled edges 139 and 147.

Figure 5:
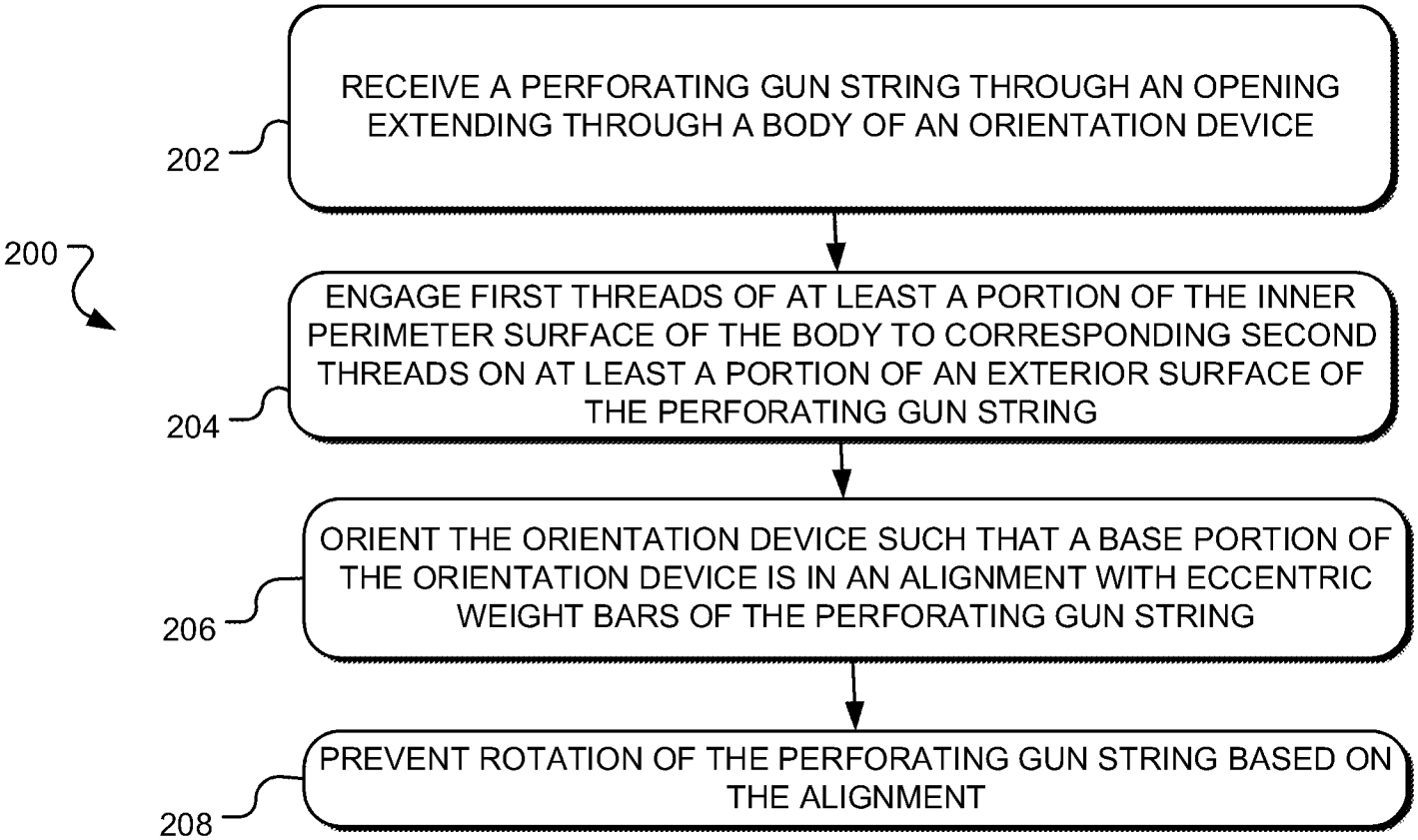
FIG. 5 is a flow chart illustrating example operations for increasing the accuracy of firing perforating charges a predetermined charge direction.

Referring to FIG. 5, example operations 200 for increasing the accuracy of firing perforating charges are. In one implementation, an operation 202 receives a perforating gun string in an opening extending through a body of at least one orienting device. An operation 204 secures first threads of at least a portion of an inner perimeter surface of the body to corresponding second threads on at least a portion of an exterior surface of the perforating gun string. An operation 206 orients the orientation device such that a base portion of the orientation device is in an alignment with eccentric weight bars of the perforating gun string. An operation 208 prevents rotation of the gun string when the perforating charges are fired based on the alignment.

It will be appreciated that the systems and methods described herein are exemplary only and other systems or modifications to these systems may be used to eliminate or otherwise increase production performance in accordance with the presently disclosed technology. It is understood that the specific order or hierarchy of steps in the methods disclosed are instances of example approaches and can be rearranged while remaining within the disclosed subject matter. The accompanying method claims thus present elements of the various steps in a sample order, and are not necessarily meant to be limited to the specific order or hierarchy presented.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined in blocks differently in various implementations of the disclosure or described with different terminology. These and other variations, modifications, additions, and improvements may fall within the scope of the disclosure as defined in the claims that follow.

What is claimed is:

1. An orientation device for increasing accuracy of firing perforating charges in an oil well casing with a perforating gun string, the orientation device comprising:

a body having a first portion and a second portion and extending between a proximal end and a distal end, the body including a first set of notches and a second set of notches, the first set of notches and the second set of notches extending from an outer perimeter surface inwardly towards a center of the body, the first set of notches disposed radially opposite from each other, and the second set of notches disposed at the proximal end;

an opening extending through a center of the body from a first lateral surface to a second lateral surface, the opening configured to receive the perforating gun string; and the outer perimeter surface extending about the center of the body from the first lateral surface to the second lateral surface, the outer perimeter surface have a first shape associated with the first portion and a second shape associated with the second portion, the second shape forming a base portion configured to maintain the perforating gun string in an orientation by preventing rotation of the perforating gun string, the orientation corresponding to a predetermined perforating charge direction of the perforating gun string.

2. The orientation device of claim 1, wherein a width of the body is tapered toward the outer perimeter surface.

3. The orientation device of claim 1, wherein the body is a single integral piece of metal.

4. The orientation device of claim 1, wherein the opening is defined by an inner perimeter surface.

5. The orientation device of claim 4, wherein an exterior surface of the perforating gun string is engaged to the inner perimeter surface.

6. The orientation device of claim 5, wherein the inner perimeter surface is engaged to the exterior surface the perforating gun string using one or more fasteners.

7. The orientation device of claim 6, wherein the one or more fasteners includes a first set of threads disposed on the inner perimeter surface.

8. The orientation device of claim 1, wherein the second portion is disposed at the distal end.

9. The orientation device of claim 1, wherein the second shape extends from a first end to a second end in a direction transverse to the first lateral surface and the second lateral surface, the first shape extending along a curve about the center of the body from the first end to the second end.

10. The orientation device of claim 1, wherein the second shape is flattened relative to the first shape.

11. A method for increasing accuracy of firing perforating charges in an oil well casing with a perforating gun string, the method comprising:

receiving the perforating gun string through an opening extending through a body of an orientation device, the opening defined by an inner perimeter surface of the body, the body extending between a proximal end and a distal end and includes a first set of notches and a second set of notches, the first set of notches and the second set of notches extending from an outer perimeter surface inwardly towards the inner perimeter surface of the body, the first set of notches disposed radially opposite from each other, and the second set of notches disposed at the proximal end;

securing first threads of at least a portion of the inner perimeter surface of the body to at least a portion of an exterior surface of the perforating gun string; and maintaining the perforating gun string in an orientation by preventing rotation of the perforating gun string.

12. The method of claim 11, wherein the rotation of the perforating gun string is prevented based on an alignment between the orientation device and the perforating gun string.

13. The method of claim 11, wherein the outer perimeter surface extending about a center of the body from a first lateral surface to a second lateral surface, the outer perimeter surface having a first shape associated with a first portion of the body and a second shape associated with a second portion of the body, the second shape forming the base portion.

14. The method of claim 13, wherein the second shape is flattened relative to the first shape.

15. The method of claim 11, wherein the orientation corresponds to a predetermined perforating charge direction of the perforating gun string.

16. A system for increasing accuracy of firing perforating charges in an oil well casing with a perforating gun string, the system comprising:

a body of an orientation device, the body extending between a proximal end and a distal end;

a first set of notches extending from an outer perimeter surface of the body inwardly towards a center of the body and disposed radially opposite from each other;

a second set of notches extending from the outer perimeter surface of the body inwardly towards the center of the body and disposed at the proximal end;

an opening extending through the center of the body from a first lateral surface to a second lateral surface, the opening configured to receive the perforating gun string; and the outer perimeter surface extending about the center of the body from the first lateral surface to the second lateral surface, the outer perimeter surface has a first shape at a first portion and a second shape at a second portion, the second shape forming a base portion configured to maintain the perforating gun string in an orientation by preventing rotation of the perforating gun string, the orientation corresponding to a predetermined perforating charge direction of the perforating gun string.

* * * * *